United States Patent [19]

Cadars

[11] 4,401,157

[45] Aug. 30, 1983

[54] DEVICE FOR TIGHTLY ASSEMBLING A COLLECTOR AND A WATER BOX IN HEAT EXCHANGER

[75] Inventor: Patrick Cadars, Montigny le Bretonneux, France

[73] Assignee: Valeo, Paris, France

[21] Appl. No.: 196,974

[22] Filed: Oct. 14, 1980

[30] Foreign Application Priority Data

Oct. 12, 1979 [FR] France ..... 79 25507

[51] Int. Cl.[3] ..... F28F 9/02

[52] U.S. Cl. ..... 165/173; 165/78; 165/DIG. 8

[58] Field of Search ..... 165/173, 175

[56] References Cited

U.S. PATENT DOCUMENTS 3,583,478 6/1971 Fieni ..... 165/175 X 4,289,507 9/1981 Cadars et al. ..... 165/42 X

FOREIGN PATENT DOCUMENTS 1962466 12/1969 Fed. Rep. of Germany .

2031669 11/1970 France .

*Primary Examiner*—Albert W. Davis, Jr.

*Attorney, Agent, or Firm*—Pollock, Vande Sande & Priddy

[57] ABSTRACT

A connecting device for assembling a collector traversed by the tubes of a tube bundle in a heat exchanger with the housing for the liquid flowing in the tubes, comprising an elastomeric sheet on the collector face opposite to the housing, wherein said elastomeric sheet comprises a marginal bulging portion projecting inwardly of the housing and cooperating with the edge of a trough located in said housing so as to delimit a collecting chamber and an expansion chamber.

12 Claims, 1 Drawing Figure

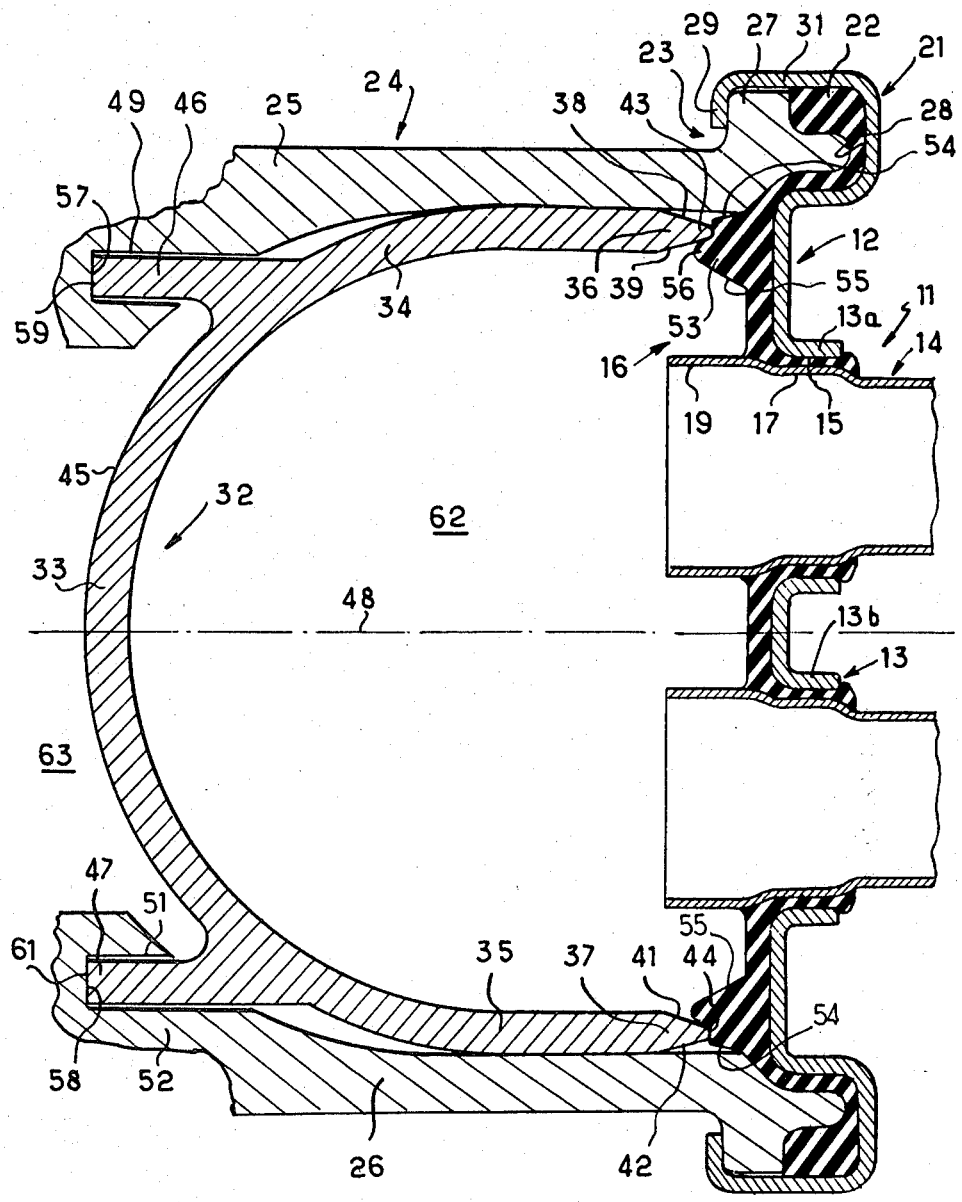
29
27
31
22
21
23
24
49
46
25
38
43
28
54
57
12
36
39
56
55
11
34
13a
59
53
14
16
19
17
15
45
32
62
33
48
13b
13
63
47
51
55
61
35
37
41
44
54
58
52
26
42

DEVICE FOR TIGHTLY ASSEMBLING A COLLECTOR AND A WATER BOX IN HEAT EXCHANGER

The invention relates to heat exchangers comprising a bundle of parallel tubes opening into a water bos through a collector or holed plate.

The collector which is a thin metallic plate is often coated with an elastomeric sheet and the sealing of the collector water box assembly is frequently obtained by clamping a peripheral bead of the elastomeric sheet between the edge of the collector and the edge of the water box.

Such an exchanger is described in particular in French Pat. No. 1 577 223 filed by the Applicant on July 21, 1967.

The invention relates particularly to devices for assembling a housing of a volume greater than that required for the water bos and the collector, a through being located within the housing so as to provide therein the water box proper in the space delimited by the housing and the collector, whereas the remainder of the housing is used for another function, which is more often that of the expansion vessel limiting a chamber for taking into account water dilatation and also for ensuring degassing thereof.

The invention is based on the fact that the openings of the end tubes of a row of tubes in the bundle into the water box are not immediately contiguous to the through wall so that one can take advantage of the elastomer areas included between the end tubes of the row and the through wall to contribute to the tightness by applying under pressure the edge of the through thereto.

The rows of tubes having free elastomeric areas at their ends are those in particular which are disposed transversely of the larger dimension of the tube bundle so that supplementary tightness is obtained on the longer side of the trough.

Application under pressure can be produced by different means and one object of the invention is to provide, to this end, such a relative dimensioning of the housing and the trough that after the assembling thereof the housing exerts a thrusting action upon that face of the through turned away from the orifice.

In accordance with the invention, the elastomeric sheet has a greater thickness, for example, of a trapezoidal cross-section along areas cooperating with the greater edges of the trough.

According to a form of embodiment, the trough comprises a longitudinal rib cooperating with a conjugate groove in the housing, which not only produces the thrusting action but alos contributes to the proper positioning of said trough.

Such a rib can be disposed centrally or on either side of a median longitudinal plane.

The invention is particularly interesting when the trough is made of plastics material so that it is then possible to take into account the practically unavoidable variations in dimensions of the parts produced by the forming or moulding methods.

In another embodiment, the trough consists of a metallic sheet having such elasticity that it is used for applying under pressure the trough edge against the elastomeric sheet by bearing on the wall of the housing.

In the following exemplifying description it is referred to the attached drawing which is a transverse cross-section of the assembly of a housing providing for the water box and the expansion vessel and comprising a device according to the invention.

The collector 11 is a thin metallic plate 12 formed with circular holes 13 used for the passage of tubes 14 constituting the tube bundle of the heat exchanger (not shown).

The holes 13 are flanged on the tubebundle side by cylindrical collars 13*a*, 13*b*. The collector on its opposite face is coated by an elastomeric sheet 16 having holes corresponding to holes 13 and sleeves 15 which in a manner known in itself are pre-stressed upon passage of tubes 14 therein and thus ensure tightness and fixation of the end of the tubes to the collector, said tubes presenting to this end, a first widened portion 17 starting from the body 14 and followed by a second widened portion 19.

The metallic plate 12 has a gutter like peripheral portion 21 of a rectangular cross-section in which a peripheral bead 22 formed in the elastomeric sheet 16 is located. Into the gutter 21 there is inserted a peripheral edge 23 formed in a housing 24 generally shaped as a rectangular parallelepipe the larger parallel walls of which are shown at 25 and 26.

The bead 23 has a lateral shoulder 27 and a rib 28 and the rib in the assembly compresses elastomer of the flange 22 when gripping means 29 at the end of lugs 31 depending from the gutter 21 are turned back.

Within the housing 24 there is disposed a trough 32 of a U-shaped cross-section having a semi-circular bottom 33 and branches or walls 34 and 35 adjacent to walls 25 and 26. Said branches are terminated by tapered or bevelled portions 36,37 limited by sloping faces 38, 39 and 41,42 respectively to define a rounded edge portion 43,44 respectively.

Trough 32 is made of plastics material and, as the case may be, either comprises end traverse portions and is then obtained by moulding or is devoid of such walls and then can be obtained by extrusion.

The trough comprises tabs 46,47 parallel to the median plane 48 common to the housing 25 and the trough 32 (when the latter is positioned) on the outer face 45 of tis rounded bottom 33, said tabs at their outer ends being located in cuts or grooves 49,51 formed in the body 52 of the housing 24.

The elastomeric sheet 16 has a bulging portion 53 on its periphery, however inside of bead 22, said bulging portion 53 having a trapezoidal cross-section delimited by sloping faces 54,55 and a front face 56.

This front face 56 is used for cooperation with the rounded edges 43 and 44 of the trough during the assembling of the housing 24 with the collector 11, the force for bringing the housing 24 and the collector 11 together being transmitted by cooperation of the bottoms 57 and 58 of the cuts 49 and 51 with the front faces 59 and 61 of the tabs 46 and 47. Even though relatively very different dimensions should exist in the troughs 32 from the same or different productions and in particular different spacings between the plane through the rounded edges 43 and 44 and the bottom of the trough (specifically the plane through the front faces 59 and 61), said edges 43 and 44 will penetrate the elastomeric material of the bulging portion 53, thereby to contribute to the tightness of the assembly.

The chamber 62 limited by the trough and the collector is the collecting chamber, and chamber 63 on the other side of the trough limited elsewhere by the housing 24 is the expansion chamber.

The collecting chamber 62 and the expansion chamber 63 communicate through calibrated orifices (not shown).

According to another embodiment, the housing is not formed with cuts and the trough is devoid of tab portions. It then consists of a metallic sheet which due to its elastricity rests against the cylindrical wall of the housing thereby applying under pressure the edge of the trough against the elastomeric sheet.

I claim:

1. A connecting device for assembling a collector traversed by the tubes of a tube bundle in a heat exchanger with the housing for the liquid flowing in the tubes, comprising an elastomeric sheet on the collector face opposite to the housing, wherein said elastomeric sheet comprises a marginal bulging portion projecting inwardly of the housing and used for cooperation with the edge of a through located in said housing so as to delimit a collecting chamber and an expansion chamber.

2. A device according to claim 1, wherein the bulging portion has a trapezoidal cross-section.

3. A device according to claim 1, wherein a peripheral bead depends from the elastomeric sheet so as to assemble in a tight relationship the periphery of the collector with a shoulder bordering the orifice of the housing.

4. A device according to claim 1, wherein thrust means are provided to bring the edge of the trough against the bulging portion in the assembling of the collector with the housing.

5. A device according to claim 4, wherein tab portions depends from the trough for cooperation with the bottom of the housing.

6. A device according to claim 5, wherein the bottom of the housing is formed with cuts complementary to the tab portions.

7. A device according to claim 4, wherein the trough is a metallic sheet the elasticity of which is used for bringing the edge of the trough against the elastomeric sheet for application of the trough to the housing.

8. A device according to claim 1, wherein the edge of the housing is in the form of a rounded ridge portion.

9. A device according to claim 8, wherein a rounded ridge is defined by two sloping faces extending the outer face and the inner face of the body of the trough.

10. A device according to claim 1, wherein the trough is terminated by transverse walls.

11. A device according to claim 1, wherein the trough is produced by extrusion of plastics material.

12. A device according to claim 1, wherein the trough is opened in the transverse direction.

* * * * *